US007255616B1

(12) United States Patent
Caldwell

(10) Patent No.: US 7,255,616 B1
(45) Date of Patent: Aug. 14, 2007

(54) STEERING SYSTEM FOR A MARINE PROPULSION DEVICE

(75) Inventor: Rodney M. Caldwell, Pawnee, OK (US)

(73) Assignee: Brunswick Corporation, Lake Forest, IL (US)

( * ) Notice: Subject to any disclaimer, the term of this patent is extended or adjusted under 35 U.S.C. 154(b) by 14 days.

(21) Appl. No.: 11/345,786

(22) Filed: Feb. 2, 2006

(51) Int. Cl.
*B63H 5/125* (2006.01)
*B63H 25/04* (2006.01)

(52) U.S. Cl. ..... 440/61 S; 440/58; 440/61 R; 440/61 A; 440/61 B; 440/61 C; 114/144 R

(58) Field of Classification Search ..... 440/61 S, 440/61 R, 61 A, 61 B, 61 C, 61 D, 61 F, 440/61 G, 58; 114/144 R
See application file for complete search history.

(56) References Cited

U.S. PATENT DOCUMENTS 3,589,326 A 6/1971 Celli ..... 115/35
3,599,595 A 8/1971 James ..... 115/34
3,626,467 A 12/1971 Mazziotti ..... 115/41
4,773,882 A * 9/1988 Rump ..... 440/61 R
5,924,379 A 7/1999 Masini et al. ..... 114/150
6,276,977 B1 8/2001 Treinen et al. ..... 440/61
6,402,577 B1 * 6/2002 Treinen et al. ..... 440/61 R
6,454,620 B1 9/2002 Theisen et al. ..... 440/61
6,524,147 B1 2/2003 Hundertmark ..... 440/61

* cited by examiner

*Primary Examiner*—Lars A. Olson
*Assistant Examiner*—Daniel V. Venne
(74) *Attorney, Agent, or Firm*—William D. Lanyi

(57) ABSTRACT

A steering system for a marine propulsion device eliminates the need for two support pins and provides a hydraulic cylinder with a protuberance and an opening which cooperate with each other to allow a hydraulic cylinder's system to be supported by a single pin for rotation about a pivot axis. The single pin allows the hydraulic cylinder to be supported by an inner transom plate in a manner that allows it to rotate in conformance with movement of a steering arm of a marine propulsion device.

20 Claims, 6 Drawing Sheets

STEERING SYSTEM FOR A MARINE PROPULSION DEVICE

BACKGROUND OF THE INVENTION

1. Field of the Invention

The present invention is generally related to a steering system for a marine propulsion device and, more particularly, to a steering system which supports a hydraulic cylinder with a single pin and which facilitates removal and installation of the hydraulic cylinder into a pivot support structure which is attached to a transom of the marine vessel.

2. Description of the Related Art

Many different types of hydraulic actuated steering systems are known to those skilled in the art. Several types of steering systems are used in conjunction with sterndrive propulsion devices and outboard motors. Typically, these steering systems exert a force to cause the marine device to rotate about a generally vertical steering axis. The steering system can include a hydraulic cylinder which is provided with pressurized hydraulic fluid through the manual movement of a steering wheel or from a pump which provides pressurized hydraulic fluid that is directed to a hydraulic cylinder through the use of a spool valve which, in turn, is controlled by manual movement of a steering wheel. The former type of system is generally referred to as a hydraulic steering system and the latter is generally referred to as a power steering system. Those skilled in the art of marine propulsion systems are also familiar with manual steering systems that use cables to move the marine propulsion device about a generally vertical steering axis.

U.S. Pat. No. 3,589,326, which issued to Celli on Jun. 29, 1971, describes an inboard outboard drive. A sterndrive for a boat having an inboard engine and an outboard drive unit is described wherein the inboard driveshaft is connected to the propeller shaft by a two section power transmission shaft, the first section being connected to the engine driveshaft at one end by a first universal joint and connected to the second section by a second universal joint. The second section of the power transmission shaft inclines downwardly and rearwardly and is connected to the propeller shaft by an acute angle by two pair of bevel gears.

U.S. Pat. No. 3,599,595, which issued to James on Aug. 17, 1971, describes an outdrive for boats. The outdrive has a hydraulic pump including an eccentric ring which is rotatable to change the path of fluid flow under pressure so that the direction of drive of the motor can be easily reversed. Hydraulic fluid may be subjected to pressure with structure prior to communication thereof to the hydraulic pump. A transom bracket and sterndrive housing support are connected so as to provide pivotal movement of the sterndrive housing along two mutually perpendicular axes so that the sterndrive housing will remain in the water even when the boat negotiates a sharp turn, the transom bracket being provided with couplings to accommodate fluid flow therethrough and a fluid restraining recess to allow recirculation of cooling water through a driving engine carried by the boat.

U.S. Pat. No. 3,626,467, which issued to Mazziotti on Dec. 7, 1971, describes a marine drive. The outdrive unit is supported substantially on a four-bar linkage. One bar of the four-bar linkage is formed by spaced locations adjacent the transom of the boat on which the outdrive unit is mounted. The second and opposite bar is formed by fixed portions of the housing for the outdrive unit. Pivotal kickup and trim for the unit is provided by the other two bars of the four-bar linkage, one of these being formed in a series of universal joints joining the gear drive, drivingly connected to the marine engine, to the shafting driving the propeller for the marine outdrive unit.

U.S. Pat. No. 5,924,379, which issued to Masini et al. on Jul. 20, 1999, discloses an actuating mechanism with an improved mounting structure. The mechanism is provided with support members that extend away from the centerline of a cylinder bore, piston and actuator rod of an actuation mechanism that uses pressure to move the piston within a cylinder bore. Two support members are attached to a cylinder housing and provided with mounting holes. The two support members are spaced apart from the cylinder housing to allow external support structures to be placed between the cylinder housing and the two support members. Appropriate fasteners, such as bolts, attach each of the two support members to the external support structures in such a way that the cylinder housing can pivot about an axis extending through both bolts. Most importantly a line extending through the support bolts intersect the cylinder bore at a place between its opposing ends. This reduces the required space necessary to allow the cylinder to pivot properly.

U.S. Pat. No. 6,276,977, which issued to Treinen et al. on Aug. 21, 2001, discloses an integrated hydraulic steering actuator. The actuator is provided for an outboard motor system in which the cylinder and piston of the actuator are disposed within a cylindrical cavity inside a cylindrical portion of a swivel bracket. The piston within the cylinder of the actuator is attached to at least one rod that extends through clearance holes of a clamp bracket and is connectable to a steering arm of an outboard motor. The one or more rods attached to the piston are aligned coaxially with an axis of rotation about which the swivel bracket rotates when the outboard motor is trimmed. As a result, no relative movement occurs between the outboard motor, the rod attached to the piston of the actuator, and the swivel bracket during rotation of the outboard motor about the axis of rotation.

U.S. Pat. No. 6,454,620, which issued to Theisen et al. on Sep. 24, 2002, discloses an integrated external hydraulic trimming and steering system for an extended sterndrive transom assembly. The system is provided with a drive unit that is attachable to a transom of a marine vessel and provided with steering cylinder assemblies and trimming cylinder assemblies which are connected to a common location on a structural member, such as a gimbal ring. This arrangement improves the geometric relationship between the steering and trimming functions. In addition, the hydraulic steering system is provided with pressure relief valves that are located at the transom of the marine vessel in order to shorten the distance of the hydraulic conduits extending between the pressure relief valves and the steering cylinders.

U.S. Pat. No. 6,524,147, which issued to Hundertmark on Feb. 25, 2003, describes a power assist marine steering system. The system comprises a hydraulically actuated, unbalanced steering cylinder assembly, a pressure source, and helm that is spaced from the steering cylinder assembly. The helm includes a helm cylinder having a slave chamber fluidically coupled to a second chamber in the steering cylinder, a high pressure port fluidically coupled to the outlet of the pressure source and to a first chamber in the steering cylinder, and a return port fluidically coupled to the vent. A control valve assembly is movable between at least first and second positions to alternatively couple a control chamber in the helm cylinder to the high pressure and return ports. In order to facilitate mounting of the helm to the dash of the watercraft, the helm has only three ports, and all three ports are all located on a rear axial end of the helm cylinder.

The patents described above are hereby expressly incorporated by reference in the description of the present invention.

In known hydraulic steering systems, a hydraulic cylinder is pivotally mounted to be able to pivot about a pivot axis as the piston rod of the assembly moves axially in response to the movement of a piston within the cavity of the hydraulic cylinder. As a distal end of the piston rod moves with a connected steering arm of the marine propulsion device, the pivotal movement of the cylinder is necessary because of the fixed relationship of the cylinder to a pivot support mechanism attached to the transom of the marine vessel and the distal end of the piston rod attached to the steering arm of the marine propulsion device. Known types of hydraulic steering systems use two pins to support the hydraulic cylinder for movement about its pivot axis. In certain types of marine vessel structures, it is difficult to remove, or perform maintenance on, these pivot pins because of spatial considerations caused by other components in the vicinity of the hydraulic cylinder. It would therefore be significantly beneficial if a support structure could be simplified so that it can be supported by a single pin which is preferably accessible from a position above the hydraulic cylinder.

SUMMARY OF THE INVENTION

A steering system for a marine vessel, in accordance with a preferred embodiment of the present invention, comprises a hydraulic cylinder, a piston disposed within the hydraulic cylinder, a piston rod attached to the piston, a protuberance extending from an outer surface of the hydraulic cylinder, and an opening formed in the outer surface of the hydraulic cylinder. The piston rod is attachable to a steering arm of a marine propulsion device. The protuberance extends from the hydraulic cylinder in a direction which is generally perpendicular to a central axis of the piston rod. The opening is shaped to receive a pin. The protuberance and the opening are disposed at generally opposite sides of the hydraulic cylinder to define a pivot axis extending through the hydraulic cylinder.

In a preferred embodiment of the present invention, the steering system can further comprise a first support structure having a first hole formed at least partially therethrough which is shaped is receive the protuberance therein and a second support structure having a second hole shaped to receive the pin. The second support structure is configured to support the pin when the pin is disposed within the opening formed in the outer surface of the hydraulic cylinder.

In a preferred embodiment of the present invention, the first and second support structures have first and second surfaces facing each other. The first and second surfaces are spaced apart by a preselected distance. The preselected distance can be greater than a maximum dimension of the hydraulic cylinder measured along the pivot axis and perpendicular to the central axis of the piston rod. The maximum dimension is measured between a first portion of the outer surface at a distal end of the protuberance and a second portion of the outer surface proximate the opening. The steering system of the present invention, in a preferred embodiment, can further comprise a clevis structure which comprises the first and second support structures and is configured to support the hydraulic cylinder between the first and second support structures for rotation about the pivot axis. The clevis structure can be attachable to a transom of the marine vessel. The first and second holes can be aligned with the pivot axis. The first support structure is disposed below the second support structure in a particularly preferred embodiment of the present invention and the hydraulic cylinder is disposed below the second support structure in a particularly preferred embodiment of the present invention.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1:
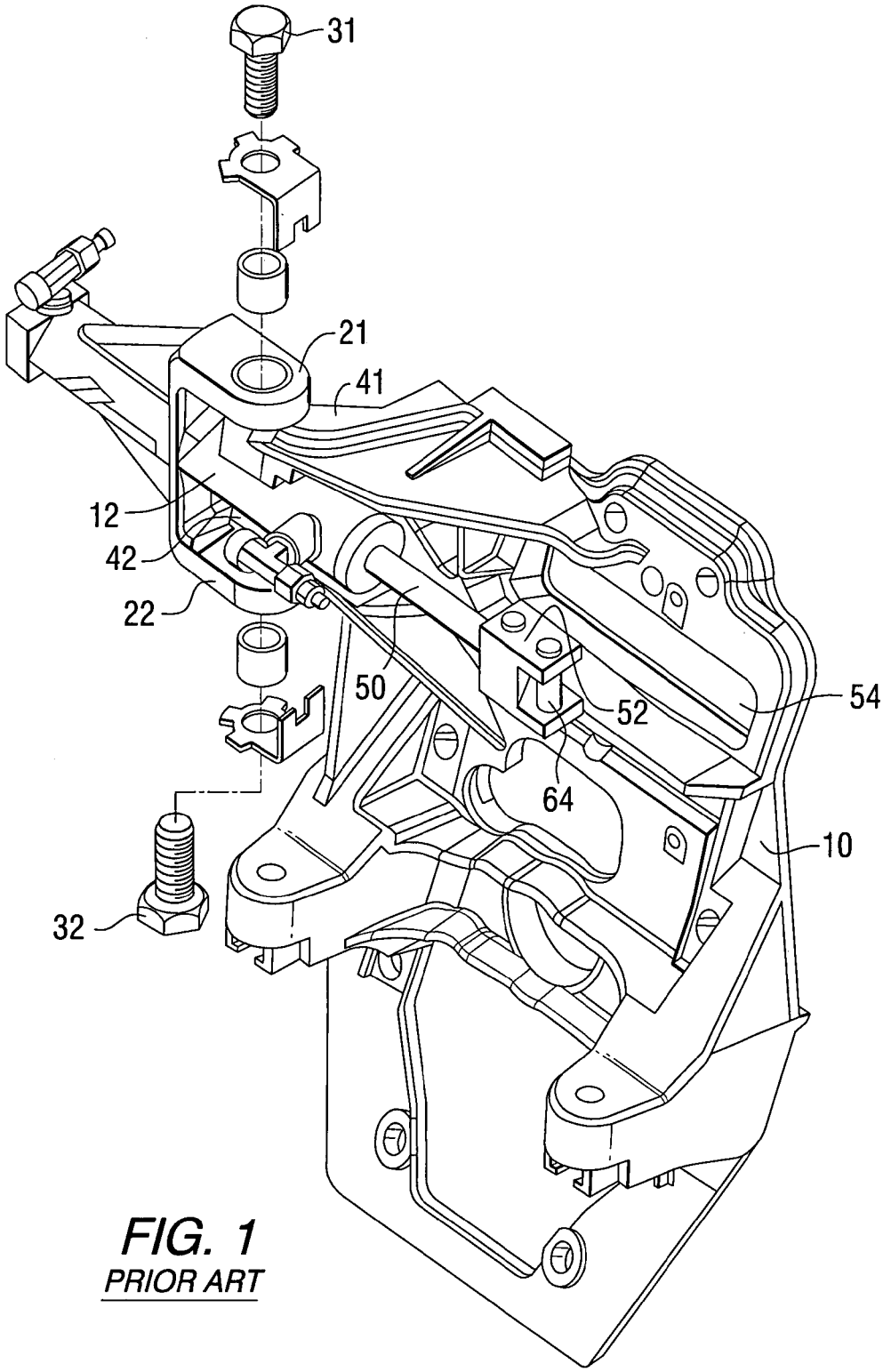
FIG. 1 PRIOR ART
FIG. 1 shows a hydraulic steering system known to those skilled in the art.

Throughout the description of the preferred embodiment of the present invention, like components will be identified by like reference numerals.

Those skilled in the art of marine propulsion devices are familiar with various techniques that are available for steering a marine vessel on which the marine propulsion device is used. FIG. 1 shows an inner transom bracket 10 to which a hydraulic cylinder 12 is pivotally attached. The particular type of hydraulic cylinder shown in FIG. 1 is also described in detail in U.S. Pat. No. 5,924,379 which is discussed above. First and second support members, 21 and 22, are attached to the hydraulic cylinder 12 and provided with holes through which first and second pins, 31 and 32, can extend. The first and second pins, 31 and 32, attach the first and second support members, 21 and 22, to first and second bracket structures, 41 and 42, in order to allow the inner transom bracket 10 to support the hydraulic cylinder 12 for rotation about a pivot axis that extends through the holes formed through the first and second support members, 21 and 22. The hydraulic cylinder 12 shown in FIG. 1 contains a piston disposed within its cavity and a piston rod 50 attached to the piston for reciprocal movement in a manner that is generally well known to those skilled in the art. An attachment mechanism 52 is provided at the distal end of the piston rod 50. The attachment mechanism 52 is attachable to a steering arm (not shown in FIG. 1) that extends through the clearance opening 54 of the inner transom plate 10. The steering arm is attached to a rotatable portion of the marine propulsion drive at the steering axis of the marine propulsion system. The inner transom plate 10 shown in FIG. 1 is attached to a forward facing surface of a transom of the marine vessel.

Figure 2:
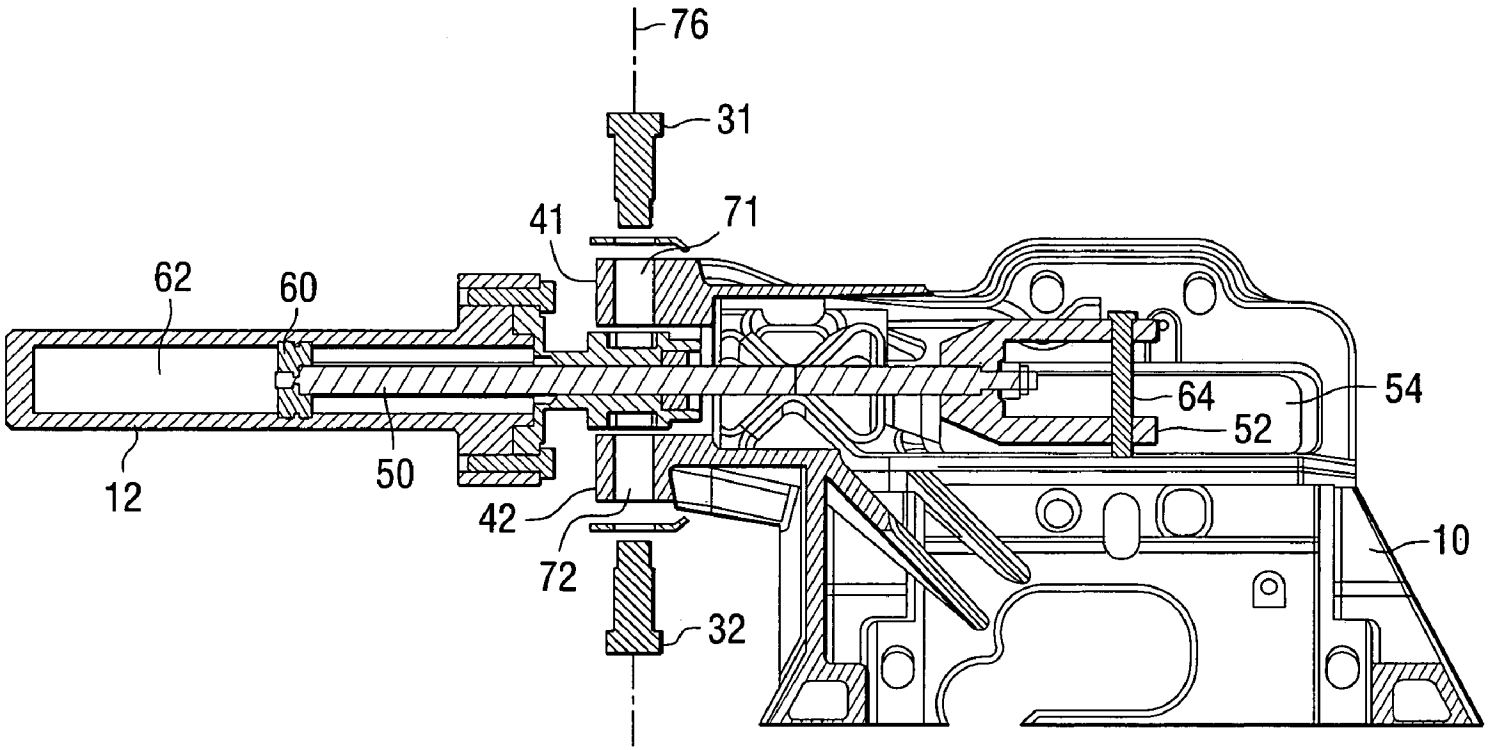
FIG. 2 PRIOR ART
FIG. 2 is a section view of a hydraulic steering system known to those skilled in the art.

FIG. 2 shows a slightly different configuration of a hydraulic cylinder 12 pivotally attached to an inner transom plate 10. The piston 60 is shown disposed within a cavity 62 of the hydraulic cylinder 12 with the piston rod 50 attached to the piston. The attachment mechanism 52 and pin 64 are illustrated in FIG. 2 but, like the illustration in FIG. 1, the steering arm is not shown. However, it should be understood that the steering arm is typically attached to the attachment member 52 by the pin 64 and extends through the clearance opening 54 of the inner transom bracket 10. The first and second support brackets, 41 and 42, extend from the inner transom bracket 10 and have holes, 71 and 72, to receive the first and second pins, 31 and 32, therethrough. In the system shown in FIG. 2, the structure of the hydraulic cylinder 12 is provided with two openings, or depressions, which receive the first and second pins, 31 and 32, so that the combination of the pins and the first and second support brackets, 41 and 42, can support the hydraulic cylinder 12 for rotation about the pivot axis 76. As the piston rod 50 moves in response to movement of the piston 60 and the steering arm moves about the steering axis of the marine propulsion device, the rotational movement of the hydraulic cylinder 12 about the pivot axis 76 accommodates the required rotation of the piston rod 50 to keep it tangential to the arc described by the hole in the steering arm through which the pin 64 extends.

Figure 3:
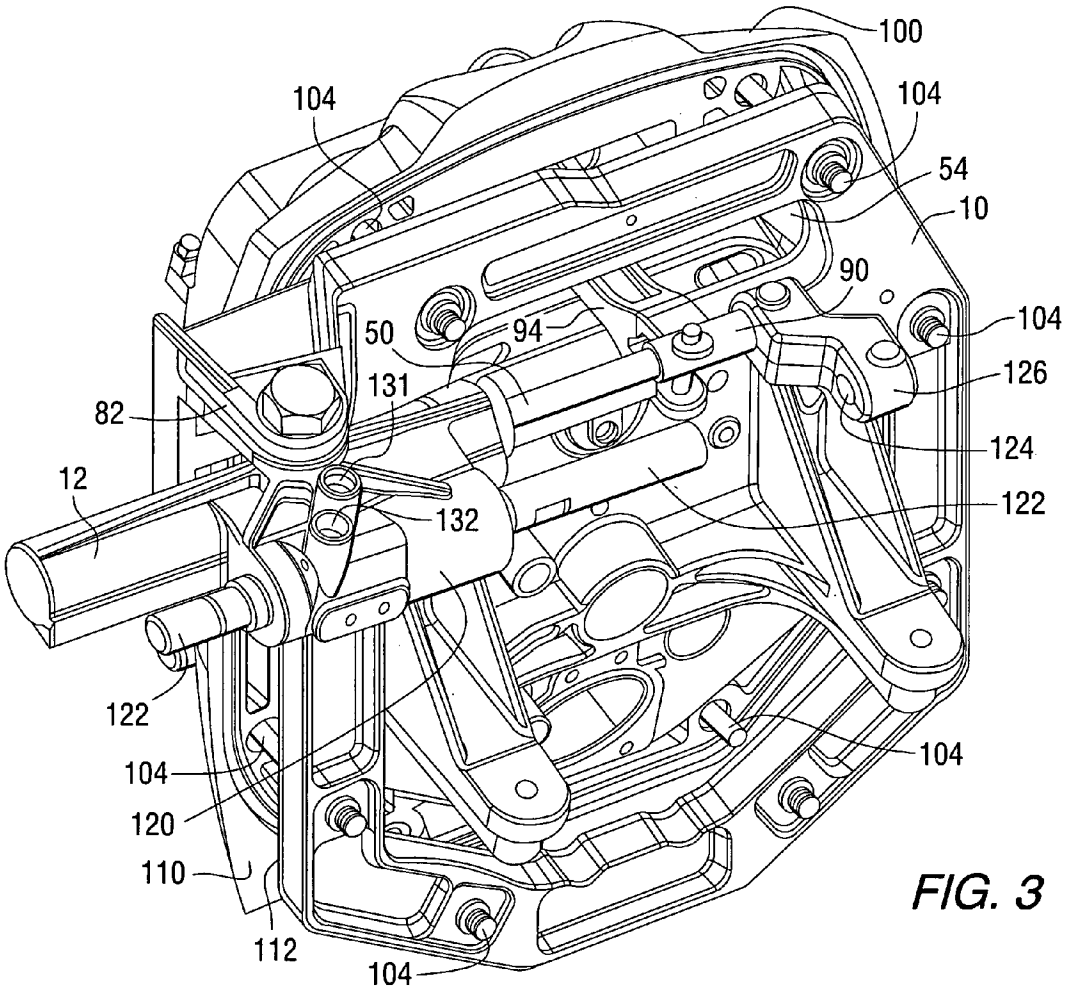
FIG. 3 is an isometric representation of a steering system made in accordance with a preferred embodiment of the present invention.

FIG. 3 illustrates a preferred embodiment of the present invention. A first support structure, which will be described in greater detail below but is not visible in FIG. 3, extends from the inner transom bracket 10. A second support structure 82 also extends from the inner transom bracket 10. A hydraulic cylinder 12 is disposed between the first and second support structures, 81 and 82. As described above, a piston rod 50 extends from the hydraulic cylinder 12 and is provided with an attachment structure 90 which is attached to a distal end of the piston rod 50. The attachment structure 90 serves a purpose which is similar to that of the attachment structure 52 described above. The steering arm 94 of the marine propulsion device is attached to the attachment structure 90 at the distal end of the piston rod 50 and extends through the clearance opening 54 which is formed in the inner transom plate 10. The transom assembly 100 is attached to the inner transom plate 10 by a plurality of bolts 104. Although not shown in FIG. 3 for purposes of clarity, the transom of a marine vessel would be disposed between the forward surface 110 of the transom assembly 100 and the rearward surface 112 of the inner transom plate 10. A marine propulsion device is normally supported behind the transom assembly 100 and is rotatable about a generally vertical steering axis to which the steering arm 94 is connected. The configuration and connection of the marine propulsion device will not be described in detail herein because of the high degree of familiarity of those skilled in the art of marine propulsion with various types of these devices which are typically referred to as sterndrive marine propulsion devices.

With continued reference to FIG. 3, the hydraulic cylinder 12 is provided with a spool valve 120 and a cylindrical member 122 through which a steering cable can extend. The cable extends through the tubular member 122 and also through the hole 124 formed in the structure 126 attached to the distal end of the piston rod 50. Movement of the steering cable causes movement of the spool valve 120 which, in turn, controls the flow of hydraulic fluid into the cavity of the hydraulic cylinder and into a preselected side of the piston 60 described above in conjunction with FIG. 2. Hydraulic ports, 131 and 132, allow hydraulic fluid to flow into and out of the spool valve 120 to control the operation of the hydraulic cylinder 12.

Figure 5:
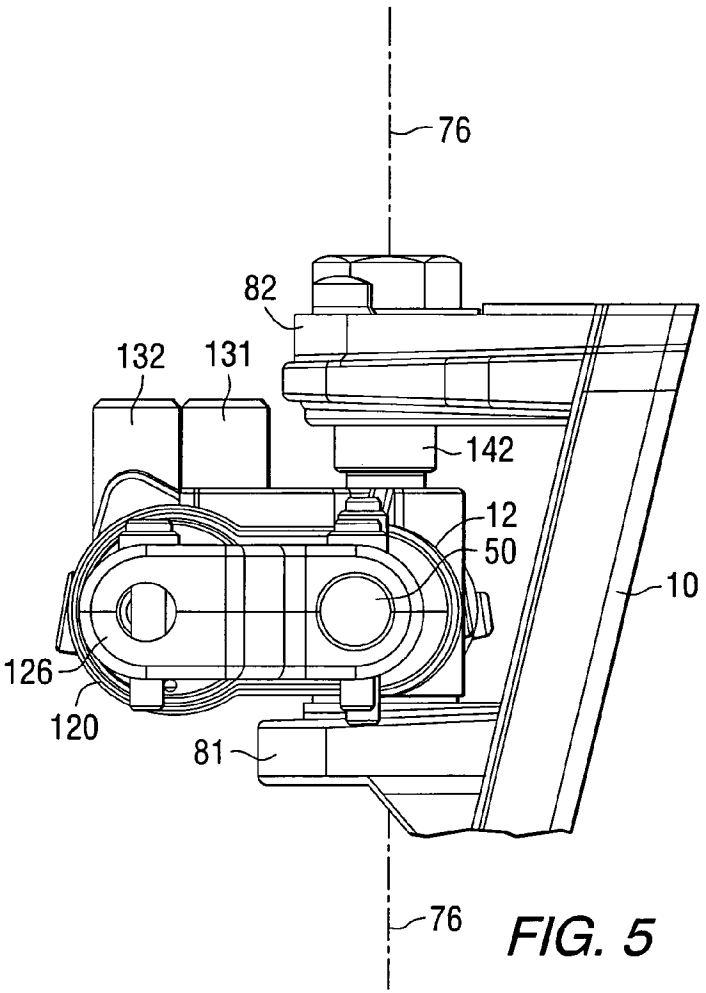
FIGS. 4 and 5 show two positions of a hydraulic cylinder device in relation to a support structure of an inner transom bracket.
Figure 4:
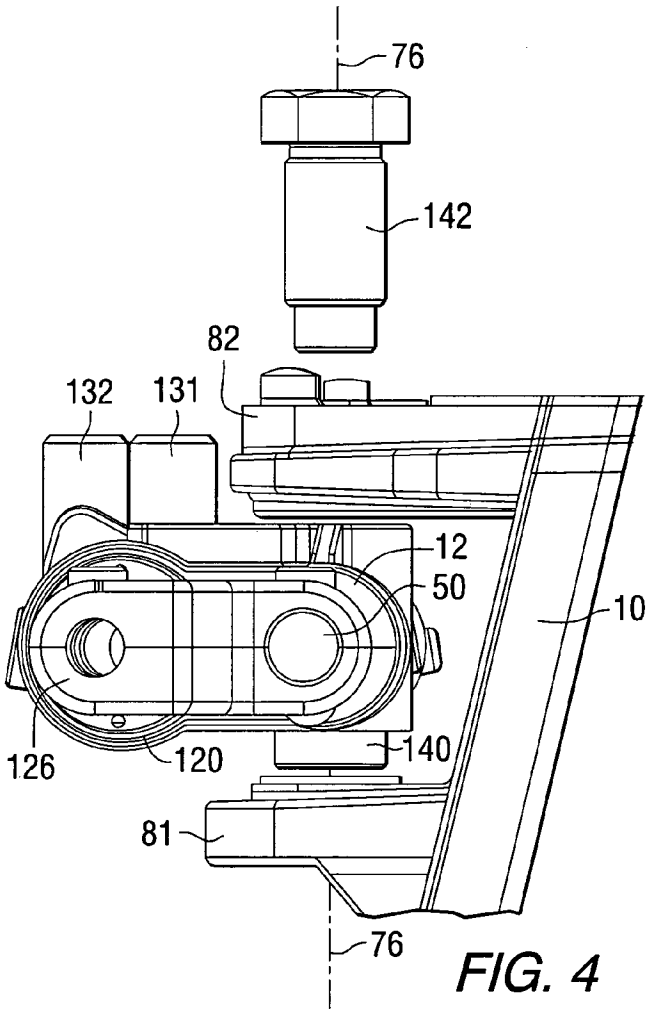

FIGS. 4 and 5 are partial views of the structure shown in FIG. 3, including end views of the hydraulic cylinder structure in combination with the first and second support structures, 81 and 82, and the inner transom assembly 10. FIG. 4 shows the position of the hydraulic cylinder structure during assembly and prior to its attachment to the first and second support structures, 81 and 82. FIG. 4 also illustrates the hydraulic cylinder 12 with the distal end of its piston rod 50. The spool valve 120 and the end structure 126 are shown to facilitate comparison between FIGS. 3 and 4.

In FIG. 4, the hydraulic cylinder structure is shown in non-contact relation with the first and second support structures, 81 and 82. This is the position in which the hydraulic cylinder structure would be temporarily supported during the process of assembly and attachment to the inner transom plate 10. A protuberance 140 extends from the hydraulic cylinder structure. It is shaped to be received in a first hole (not visible in FIG. 4) formed in the first support structure 81. An opening (not visible in FIG. 4) is formed in the hydraulic cylinder structure and shaped to receive a pin 142 which extends through a second hole (not visible in FIG. 4) and into the opening of the hydraulic cylinder. The protuberance 140 and opening formed in the hydraulic cylinder are disposed at generally opposite sides of the hydraulic cylinder in order to define a pivot axis 76 which is generally similar in function and position to the pivot axis 76 described above in conjunction with FIG. 2. It can be seen in FIG. 4 that the protuberance 140 is not disposed in the first hole of the first support structure 82 and the pin 142 is not disposed in the opening formed in the hydraulic cylinder.

FIG. 5 shows the assembly after the hydraulic cylinder is lowered from the position shown in FIG. 4 so that the protuberance (not visible in FIG. 5) is received in the first hole formed in the first support structure 81. In addition, the pin 142 has been inserted through a second hole in the second support structure 82 and into the opening formed in the hydraulic cylinder. When the pin 142 is threaded into the second hole in the second support structure 82, it locks the hydraulic cylinder assembly into place relative to the inner transom plate and supports the hydraulic cylinder assembly for rotation about the pivot axis 76.

Figure 6:
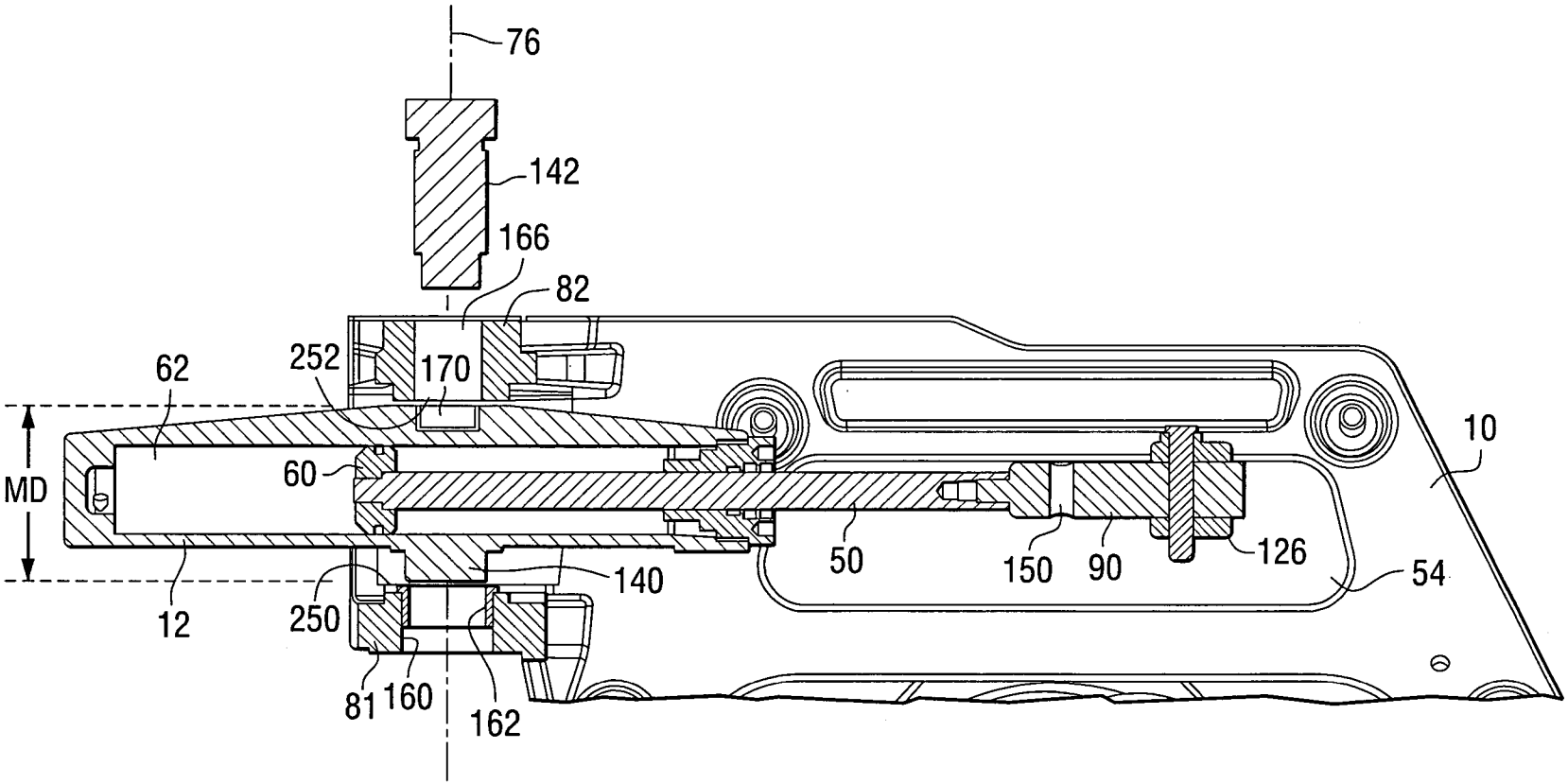
FIG. 6 is a section view of a preferred embodiment of the present invention.

FIG. 6 is a section view of the assembly shown in FIG. 3. The section view is taken along a vertical plane extending through the center of the piston rod 50. In FIG. 6, the hydraulic cylinder 12 is shown suspended between the first and second support structures, 81 and 82, in a manner generally similar to its position shown in FIG. 4. The hydraulic cylinder 12 in FIG. 6 is shown with the piston 60 disposed within the cavity 62 and the piston rod 50 attached to the piston 60. At the distal end of the piston rod 50, the attachment member 90 is shown with a hole 150 which is shaped to receive a pin which allows it to be attached to the steering arm (not shown in FIG. 6, but identified by reference numeral 94 in FIG. 3). The steering arm extends through the clearance opening 54.

With continued reference to FIG. 6, the protuberance 140 is shown suspended directly above the first hole 160 formed in the first support structure 81. A sleeve 162 is disposed in the first hole 160 as shown. The opening 170 is formed in the hydraulic cylinder 12 and shaped to receive the pin 142. The second support structure 82 has a second hole 166 formed through it and shaped to receive the pin 142.

With continued reference to FIG. 6, it can be seen that the hydraulic cylinder structure is supported through the use of a single pin 142. This represents a significant improvement over known hydraulic cylinder structures because it eliminates the need for providing a second pin which extends in an upward direction through a lower support bracket as described above in conjunction with FIGS. 1 and 2. The requirement of a second pin extending in an upward direction to support the hydraulic cylinder structure is disadvantageous in two important ways. First, gravity can urge the lower pin in a downward direction and, under certain extreme circumstances, cause the pin to become disconnected from the structure. More commonly, access to the lower pin can be difficult when other structures are located in the near vicinity to the inner transom bracket 10. Removal of the lower pin can therefore be difficult because of this limited access after the marine propulsion device is installed in a marine vessel. The present invention eliminates these two disadvantages by utilizing a single pin 142 which is easily accessible from above the hydraulic cylinder. The function previously performed by the lower pin is provided by the protrusion 140 extending from the hydraulic cylinder 12.

Figure 7:
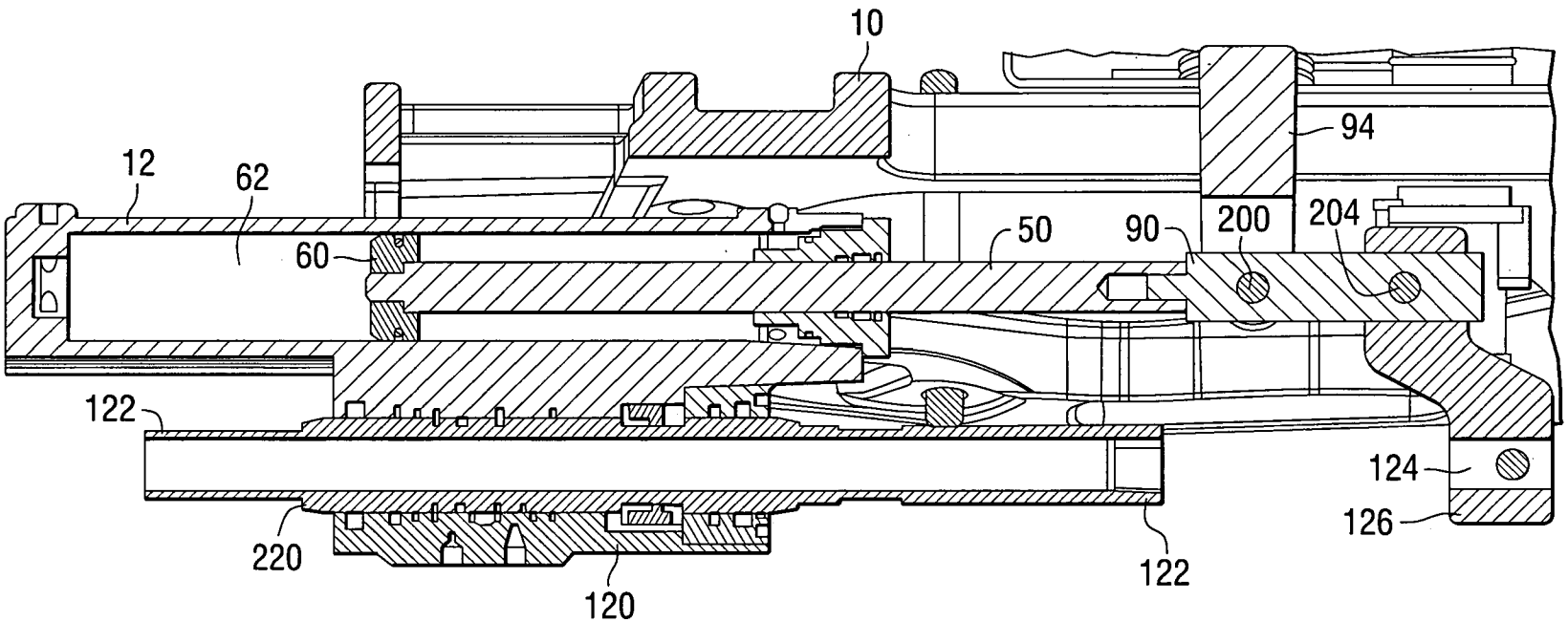
FIG. 7 is a second section view of a preferred embodiment of the present invention.

FIG. 7 is a section view taken through the structure illustrated in FIG. 3. The section view of FIG. 7 is taken along a horizontal plane which extends through the center of the piston rod 50. In FIG. 7, the piston 60 is shown disposed within the cavity 62 of the hydraulic cylinder 12 and the piston rod 50 is shown extending from the hydraulic cylinder. The attachment member 90 is shown attached to the steering arm 94 by the pin 200. The attachment member 90 is also shown attached to the connection apparatus 126 by pin 204. Although not shown in FIG. 7, it should be understood that a steering cable is intended to extend through the cylindrical member 122 and through hole 124 which is described above in conjunction with FIG. 3. The spool valve 120 is provided with a spool 220 which directs the flow of hydraulic fluid to a selected side of the piston 60, within cavity 62, as a function of movement of the spool 220 axially relative to the spool valve 120. This movement occurs as a result of movement of the steering cable which extends through the cylindrical member 122.

With reference to FIGS. 3-7, it can be seen that a steering system for a marine vessel, made in accordance with a preferred embodiment of the present invention, comprises a hydraulic cylinder 12, a piston 60 disposed within the hydraulic cylinder 12, a piston rod 50 attached to the piston 60, a protuberance 140 extending from the hydraulic cylinder in a direction which is generally perpendicular to a central axis of the piston rod 50, and an opening 170 formed in the hydraulic cylinder. The opening 170 is shaped to receive a pin 142. The protuberance 140 and the opening 170 are disposed at generally opposite sides of the hydraulic cylinder 12 to define a pivot axis 76 which extends through the hydraulic cylinder 12. A first support structure 81 has a first hole 160 formed at least partially therethrough. The first hole 160 is shaped to receive the protuberance 140 therein. The second support structure 82 has a second hole 166 shaped to receive the pin 142. The second support structure 82 is configured to support the pin 142 when the pin is disposed within the opening 170 formed in the hydraulic cylinder. The first support structure 81 has a first surface 250 facing the second support structure 82. The second support structure 82 has a second surface 252 facing the first support structure 81. The first and second surfaces, 250 and 252, are spaced apart by a preselected distance. The preselected distance between the first and second surfaces, 250 and 252, is greater than a maximum dimension MD of the hydraulic cylinder 12 measured along the pivot axis 76 and perpendicular to the central axis of the piston rod 50. The maximum dimension MD is measured between a first portion of the outer surface of the hydraulic cylinder 12 at a distal end of the protuberance 140 and a second portion of the outer surface proximate the opening 170. A clevis structure, as illustrated in FIGS. 3 and 6, can comprise the first and second support structures, 81 and 82, and is configured to support the hydraulic cylinder 12 between the first and second support structures, 81 and 82, for rotation about the pivot axis 76. The clevis structure, as part of the inner transom plate 10, is attachable to a transom of a marine vessel. The first and second holes, 160 and 166, are aligned with the pivot axis 76. The first support structure 81 is disposed below the second support structure 82 in a preferred embodiment of the present invention and the hydraulic cylinder 12 is disposed below the second support structure 82.

It should be understood that the present invention has been described in terms of a hydraulic cylinder 12 and its outer surface, but that this terminology can include extensions and additional devices which are attached to the basic structure of the hydraulic cylinder. In other words, support members such as those described in U.S. Pat. No. 5,924,379 (identified by reference numerals 160 and 180 in that patent) should be understood to be included within the term "hydraulic cylinder". In addition, reference to an outer surface of the hydraulic cylinder, in certain embodiments of the present invention, should be understood to include within its definition the outer surfaces of these types of extension devices.

Although the present invention has been described with particular specificity and illustrated to show a preferred embodiment, it should be understood that alternative embodiments are also within its scope.

I claim:

1. A steering system for a marine vessel, comprising:

a hydraulic cylinder;

a piston disposed within said hydraulic cylinder;

a piston rod attached to said piston, said piston rod being attachable to a steering arm of a marine propulsion device;

a protuberance extending from said hydraulic cylinder in a direction which is generally perpendicular to a central axis of said piston rod; and an opening formed in said hydraulic cylinder, said opening being shaped to receive a pin, said protuberance and said opening being disposed at generally opposite sides of said hydraulic cylinder to define a pivot axis extending through said hydraulic cylinder.

2. The steering system of claim 1, further comprising:

a first support structure having a first hole formed at least partially therethrough which is shaped to receive said protuberance therein; and a second support structure having a second hole shaped to receive said pin, said second support structure being configured to support said pin when said pin is disposed within said opening formed in said hydraulic cylinder.

3. The steering system of claim 2, wherein:

said first support structure has a first surface facing said second support structure;

said second support structure has a second surface facing said first support structure; and said first and second surfaces are spaced apart by a preselected distance.

4. The steering system of claim 3, wherein:

said preselected distance is greater than a maximum dimension of said hydraulic cylinder measured along said pivot axis and perpendicular to said central axis of said piston rod.

5. The steering system of claim 4, wherein:

said maximum dimension is measured between a first portion of said hydraulic cylinder at a distal end of said protuberance and a second portion of said hydraulic cylinder proximate said opening.

6. The steering system of claim 2, further comprising:

a clevis structure which comprises said first and second support structures and is configured to support said hydraulic cylinder between said first and second support structures for rotation about said pivot axis.

7. The steering system of claim 6, wherein:

said clevis structure is attachable to a transom of said marine vessel.

8. The steering system of claim 2, wherein:

said first and second holes are aligned with said pivot axis.

9. The steering system of claim 2, wherein:

said first support structure is disposed below said second support structure.

10. The steering system of claim 2, wherein:

said hydraulic cylinder is disposed below said second support structure.

11. A steering system for a marine vessel, comprising:

a first support member attached to a transom of said marine vessel;

a second support member attached to said transom of said marine vessel;

a steering arm of a marine propulsion drive;

a hydraulic cylinder comprising a housing and an internal cavity;

a piston disposed within said internal cavity;

a piston rod attached to said piston, said piston rod being attached to said steering arm;

a protuberance extending from said housing in a direction which is generally perpendicular to a central axis of said piston rod;

an opening formed in said housing, said protuberance and said opening being disposed at opposite sides of said hydraulic cylinder to define a pivot axis extending through said hydraulic cylinder; and a pin, said protuberance being disposed in a first hole formed in said first support member, said pin extending through a second hole formed in said second support member, an end of said pin being disposed within said opening.

12. The steering system of claim 11, wherein:

said housing being sized to be received between said first and second support members when said protuberance is disposed out of said first hole with said pivot axis extends through said first and second holes.

13. The steering system of claim 11, wherein:

said protuberance is disposed below said opening.

14. The steering system of claim 11, wherein:

said first and second support members are part of a clevis structure which is rigidly attached to said marine vessel.

15. The steering system of claim 11, wherein:

said first support structure has a first surface facing said second support structure;

said second support structure has a second surface facing said first support structure; and said first and second surfaces are spaced apart by a preselected distance.

16. The steering system of claim 15, wherein:

said preselected distance is greater than a maximum dimension of said hydraulic cylinder measured along said pivot axis and perpendicular to said central axis of said piston rod.

17. The steering system of claim 16, wherein:

said maximum dimension is measured between a first portion of said housing at a distal end of said protuberance and a second portion of said housing proximate said opening.

18. A steering system for a marine vessel, comprising:

a hydraulic cylinder;

a piston disposed within said hydraulic cylinder;

a piston rod attached to said piston, said piston rod being attachable to a steering arm of a marine propulsion device;

a pivot insert extending from said hydraulic cylinder in a direction which is generally perpendicular to a central axis of said piston rod; and a receptacle formed in said hydraulic cylinder, said receptacle being shaped to receive a pin, said pivot insert and said receptacle being disposed at generally opposite sides of said hydraulic cylinder to define a pivot axis extending through said hydraulic cylinder.

19. The steering system of claim 18, further comprising:

a first support structure having a first hole formed at least partially therethrough which is shaped to receive said pivot insert therein; and a second support structure having a second hole shaped to receive said pin, said second support structure being configured to support said pin when said pin is disposed within said receptacle formed in said hydraulic cylinder.

20. The steering system of claim 19, wherein:

said first support structure has a first surface facing said second support structure;

said second support structure has a second surface facing said first support structure;

said first and second surfaces are spaced apart by a preselected distance;

said preselected distance is greater than a maximum dimension of said hydraulic cylinder measured along said pivot axis and perpendicular to said central axis of said piston rod;

said maximum dimension is measured between a first portion of said hydraulic cylinder at a distal end of said pivot insert and a second portion of said hydraulic cylinder proximate said receptacle;

said first and second support structures are integral segments of a clevis structure which is configured to support said hydraulic cylinder between said first and second support structures for rotation about said pivot axis;

said clevis structure is attachable to a transom of said marine vessel;

said first and second holes are aligned with said pivot axis;

said first support structure is disposed below said second support structure; and said hydraulic cylinder is disposed below said second support structure.

* * * * *